US008222813B2

(12) United States Patent
Krusos et al.

(10) Patent No.: US 8,222,813 B2
(45) Date of Patent: Jul. 17, 2012

(54) MATRIX PHOSPHOR COLD CATHODE DISPLAY EMPLOYING SECONDARY EMISSION

(75) Inventors: Denis Krusos, Melville, NY (US); Anthony Campisi, Melville, NY (US)

(73) Assignee: Copytele, Inc., Melville, NY (US)

( * ) Notice: Subject to any disclaimer, the term of this patent is extended or adjusted under 35 U.S.C. 154(b) by 290 days.

(21) Appl. No.: 12/079,658

(22) Filed: Mar. 28, 2008

(65) Prior Publication Data

US 2009/0102389 A1 Apr. 23, 2009

Related U.S. Application Data

(60) Provisional application No. 60/999,783, filed on Oct. 19, 2007, provisional application No. 61/000,958, filed on Oct. 30, 2007.

(51) Int. Cl.
*H01J 17/49* (2012.01)

(52) U.S. Cl. ..... 313/587

(58) Field of Classification Search ..... 313/587
See application file for complete search history.

(56) References Cited

U.S. PATENT DOCUMENTS

| | | | | |
|---|---|---|---|---|
| 2005/0184675 | A1* | 8/2005 | Zoulkarneev et al. | 315/169.3 |
| 2006/0012304 | A1* | 1/2006 | Son et al. | 313/586 |
| 2006/0170330 | A1* | 8/2006 | DiSanto et al. | 313/495 |
| 2007/0080640 | A1* | 4/2007 | Son et al. | 313/582 |

* cited by examiner

*Primary Examiner* — Anh Mai
*Assistant Examiner* — Andrew Coughlin
(74) *Attorney, Agent, or Firm* — Law Office of Carl Giordano, PA

(57) ABSTRACT

A vacuum flat panel display including: a plurality of electrically addressable pixels; a plurality of thin-film transistor driver circuits each being electrically coupled to an associated at least one of the pixels, respectively; a passivating layer on the thin-film transistor driver circuits and at least partially around the pixels; a conductive frame on the passivating layer, said frame and pixel area coated with an insulator; and, a plurality of cathode emitters are deposited on the coated frame while phosphor is deposited on the coated pixel; wherein, exciting the cathode emitters and addressing one of the pixels using the associated driver circuit causes the emitted electrons to induce one of the pixels to emit light. By introducing a noble gas or mixture, and a ML layer having a DC, AC or pulsed voltage applied thereto, one creates a plasma to form a sheath boundary at the insulator causing electron multiplication and increased illumination.

19 Claims, 5 Drawing Sheets

MATRIX PHOSPHOR COLD CATHODE DISPLAY EMPLOYING SECONDARY EMISSION

RELATED APPLICATIONS

Applications entitled "Passive Matrix Phosphor Based Cold Cathode Display", Ser. No. 60/999,783, filed on Oct. 19, 2007, "Active Matrix Phosphor Cold Cathode Display", Ser. No. 61/000,958, filed on Oct. 30, 2007and other pending applications regarding flat panel display technology.

FIELD OF THE INVENTION

This application is generally related to the field of displays and more particularly to flat panel displays employing phosphor pixels, frame and cold cathode emission sources, and providing increased secondary emission for excitation of the phosphor by electron bombardment.

BACKGROUND OF THE INVENTION

Flat panel display (FPD) technology is one of the fastest growing display technologies in the world. As a result of this growth, a large variety of FPDs exist, which range from very small virtual reality eye tools to large hang-on-the-wall television displays. Copytele, the applicant herein, has many patents and applications relating to such displays.

It is desirable to provide a display device that may be operated in a cold cathode field emission configuration such as nanotubes, edge emitters, etc. and that exhibits a uniform, enhanced and adjustable brightness with good electric field isolation between pixels. Such a device would be particularly useful as a low voltage FPD, incorporating a cold cathode electron emission system, a pixel control system, and phosphor based pixels, with or without memory and active devices such as transistors including those of the thin film construction. It is further desirable to provide a brighter display and, therefore, there is described the use of an insulator coating on the frame of such devices to cause increased electron emission for the purpose of exciting the phosphor by increased electron bombardment.

SUMMARY OF THE INVENTION

In one exemplary embodiment, a flat panel display including: a plurality of electrically addressable pixels; a plurality of thin-film transistor driver circuits each being electrically coupled to an associated at one of the pixels, respectively; a passivating layer on the thin-film transistor driver circuits and at least partially around the pixels; a conductive frame on the passivating layer; and a thin layer of an insulator material deposited on the frame and pixel, and a plurality of cold cathode emitters deposited on top of the insulator material on the frame, and a phosphor deposited on the pixel which is surrounded by the frame; wherein, exciting the conductive frame and addressing one of the pixels using the associated driver circuit causes the cold cathode emitters to emit electrons that induce one of the pixels to emit light; wherein, some emitted electrons strike gas atoms on route to the pixel. The ions return to the frame causing additional electrons to be released especially in the area of the frame covered with insulator.

In one exemplary embodiment, there is provided a thin, phosphor-based active TFT matrix flat panel display. Adjacent each pixel in the matrix is a control conductive frame which contains cold cathode emitters and which frame is completely or partially covered with an insulator such as $SiO_2$ or $M_gO$, for producing additional electrons. The ions return to the frame causing additional electrons to be released. When the ions return to the frame covered with the insulator more electrons are released allowing for more efficient illumination of the phosphor. When the hollow of the display is filled with a noble gas and a plasma is produced in the gas, the insulator on the conductive frame forms a potential variation at the surface of the insulator or forms a boundary. This boundary is a sheath and when, as above, ions are produced they return to the frame and strike or hit the sheath to cause electrons to be released causing electron multiplication for further increasing the illumination. Each pixel has color or monochrome phosphors located on the layer of insulation on the pixel. The pixels are activated by electrons created by a voltage potential between the frame and the pixel. The electrons strike the phosphor and cause the phosphor to emit light. Each pixel is addressed through a TFT matrix structure (e.g. a memory TFT matrix). The apparatus causes increased secondary emission for the purpose of increased excitation of the phosphor by electron bombardment.

BRIEF DESCRIPTION OF THE DRAWINGS

It is to be understood that the accompanying drawings are solely for purposes of illustrating the concepts of the invention and are not drawn to scale. The embodiments shown in the accompanying drawings, and described in the accompanying detailed description, are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE INVENTION

Figure 1:
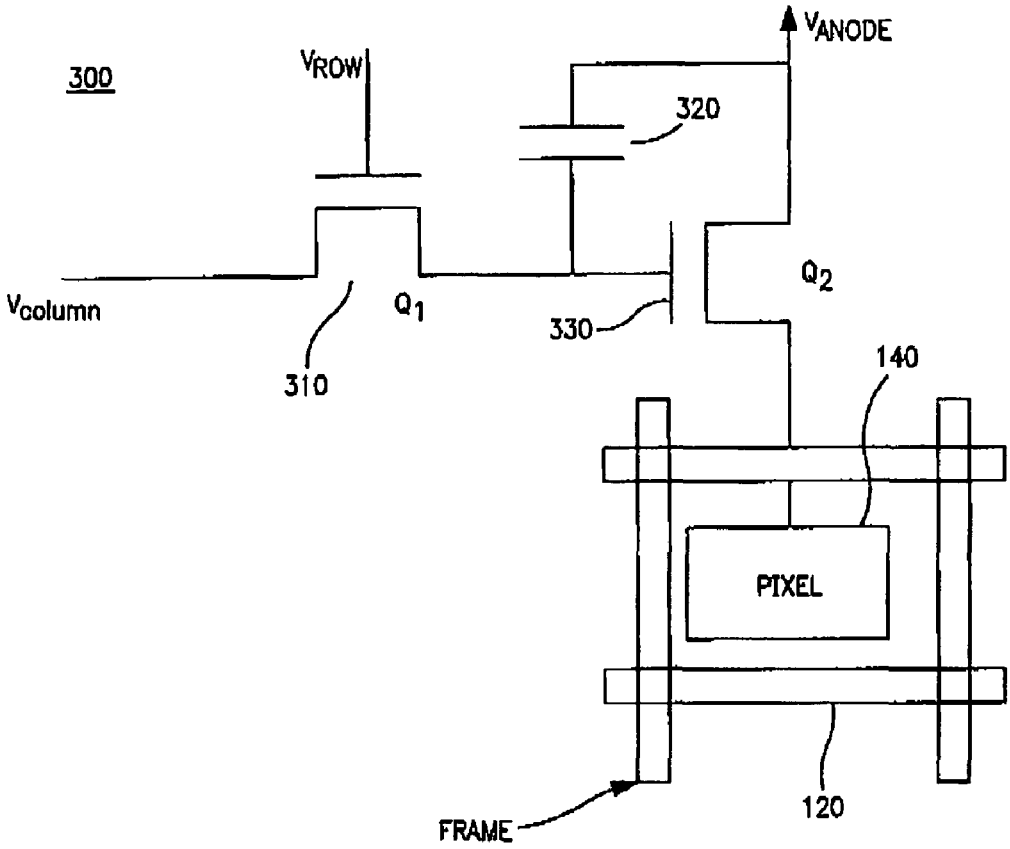
FIG. 1 illustrates a circuit for driving the pixels according to an aspect of the present invention

It is to be understood that the figures and descriptions of the present invention have been simplified to illustrate elements that are relevant for a clear understanding of the present invention, while eliminating, for purpose of clarity, many other elements found in typical display (e.g. FPD) systems and methods of making and using the same. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. Furthermore, while the present invention has been described with reference to the illustrative embodiments, this description is not intended to be construed in a limiting sense. Various modifications of the illustrative embodiments, as well as other embodiments of the invention, will be apparent to those skilled in the art on reference to this description.

Before embarking on a more detailed discussion, it is noted that there are other passive matrix displays and active matrix displays that are used in laptop and notebook computers. In a passive matrix display, there is a matrix of solid-state elements in which each element or pixel is selected by applying a potential voltage to a corresponding row and column line that forms the matrix. In an active matrix display, each pixel is further controlled by at least one transistor and a capacitor that is also selected by applying a potential to a corresponding row and column line. Part of the invention lies in the recognition that a TFT-based display device with a control frame disposed thereon exhibits enhanced performance and effects useful for display devices. Electron emission sources may be used with such a frame to form a cold cathode configuration, such as one including edge emitters, or nanotube emitters, and or other cold cathode electron emitters. Cold cathode emitters may also be used which are not associated with the frame. This has been disclosed in pending applications (see Related Applications). Here there is described increased secondary emission of an FED display for enhancing illumination of the display.

According to an aspect of the present invention, a pixel matrix control system having a control frame around each pixel associated with a thin film transistor (TFT) circuit of a display device is used to provide a display characterized as having a good uniformity, adjustable brightness, and a good electric field isolation between pixels, regardless of the type of electron source used. For purposes of completeness, a TFT is a type of field effect transistor made by depositing thin films for the metallic contacts, semiconductor active layer, and dielectric layer. TFT's are widely used in liquid crystal display (LCD) FPDs.

The control frame surrounds the pixel and hence, the TFT, and is disposed in an inactive area between the pixels (e.g. on an insulating substrate over the respective columns and rows). The control frame can accommodate carbon nanotube or other electron emission sources. The control frame and pixel have a thin layer of insulator such as $SiO_2$ or $M_gO$ deposited thereon. Carbon nanotubes (CNT) are then deposited on top of the insulator on the frame. Phosphor is deposited on top of the pixel area. During operation electrons emitted by the nanotubes go to the pixel. The electrons strike the phosphor on the pixel causing the phosphor to illuminate. Some electrons strike gas atoms producing ions and more electrons. The ions return to the frame causing additional electrons to be released. When the ions strike the frame covered with insulator more electrons are released. Another implementation is to first deposit the nanotubes and then cover the nanotubes with a thin layer of $SiO_2$ or $M_gO$.

According to an aspect of the present invention, the control frame includes a plurality of conductors, typically arranged in a matrix having parallel horizontal conductors and parallel vertical conductors. Each pixel is bounded by the intersection of vertical and horizontal conductors, such that the conductors surround the corresponding pixels to the right, left, top, and bottom in a matrix fashion. One or more conductive pixel pads are electrically connected to the control frame. The control frame may be fabricated of a metal including, for example, chrome, molybdenum, aluminum, and/or combinations thereof.

According to an aspect of the present invention, the control frame can be formed using standard lithography, deposition and etching techniques.

In one exemplary configuration, conductors parallel to columns and rows are electrically connected together, and a voltage is applied thereto. In another exemplary configuration, conductors parallel to columns are electrically connected together, and have a voltage applied thereto. Conductors parallel to the rows are also connected together, with a voltage applied thereto. In yet another exemplary configuration, a voltage is only applied to one of the parallel rows or columns of conductors.

According to an aspect of the present invention, a vacuum FPD or a FPD containing a noble gas in the hollow of the display, incorporating a TFT circuit may be provided. Associated with each pixel element is a TFT circuit that is used to selectively address that pixel element in the display. In one configuration the TFT circuit includes first and second active device electrically cascaded, and a capacitor coupled to an output of the first device and an input of the second device.

Referring to FIG. 1, there is shown a TFT circuit 300 for driving a pixel 140 according to this invention, the TFT substrate of the display consists of the desired number of pixels each having the configuration shown in FIG. 1. The pixels consist of conductive layer coated with phosphor (red, green, or blue). The Frame 120 consists of a conductive material (for ex. chrome, aluminum, etc.). On this frame 120 one then deposits $SiO_2$ or $M_gO$. The frame around the pixel will be deposited with carbon nanotubes after the insulator. However the nanotubes can be deposited first and then the insulator. For example, an insulator such as $SiO_2$ or magnesium oxide ($M_gO$) is deposited on the frame and pixel area (metalized portion). This layer is thin as less than 100 Å. The insulator layer can completely cover the frame or partially cover the frame 120. The layer can be porous. Carbon nanotubes (CNT) are deposited on top of the insulator on the frame 120 and then phosphor is deposited on top of the insulator on the pixel 140.

Referring to FIG. 1 the display operates as follows: When a row is selected ($V_{row}$=15V) this enables new column data ($V_{col}$) to be stored at this particular TFT active matrix location ($V_{cap}$). Although 15V has been used, one can employ a voltage between 10-30V. When $V_{row}$=0V this particular active matrix location is not selected and new data can't be written to $V_{cap}$. It should be noted that the ($V_{row}$=15V) of FIG. 1 may be any other voltage sufficient enough to turn on transistor Q1 310. It should also be noted that $V_{row}$=0V of FIG. 1 may be any other voltage sufficient enough to turn off transistor Q1 310. The voltages used are basically only a function of the minimum voltage requirement of the Drivers and the TFT used. When the data stored at location $V_{cap}$ 320 is greater than the threshold voltage of Q2 330 this allows current to flow through transistor Q2 330 (Q2 is on). When the data stored at location $V_{cap}$ is less than the threshold voltage of Q2, transistor Q2 is cut off and current can't flow through Q2 (Q2 is off). When transistor Q2 is on this applies a voltage positive relative to the frame voltage to the pixel pad. The frame 120 has a negative voltage relative to the pixel pad 140. Since the pixel voltage is positive relative to the Frame 120 (Vpixel more positive than Vframe) the electrons emitted by the nanotubes go to the pixel. The electrons strike the phosphor on the pixel causing the phosphor to illuminate. Some electrons strike gas atoms in route to the pixel producing ions and additional electrons. The ions will return to the frame causing the additional electrons to be released. However it has been found that the ions that return to the frame area covered with $SiO_2$ or $M_gO$ or any other suitable semi-insulator to release more electrons. This greater multiplication of electrons allows for more efficient illumination of the phosphor. In any event another aspect for increasing or obtaining electron multiplication is the generation of a sheath formed as a boundary between the insulator layer and a plasma. The hollow of the display is filled with a noble gas such as Argon, Helium, Krypton, Xenon, etc. or mixtures thereof. Ionization of a noble gas creates a plasma within the hollow of the display.

The potential variation at the surface of the walls of the insulator is a boundary between the plasma and the insulator ($SiO_2$, $M_gO$) Sheath is this boundary. The sheath unit forms around any probe that may be immersed in the plasma of the discharge is an example of such a boundary through which charges may flow. The sheath that forms at the surface of insulation will accrue from the presence of an excess number of electrons. However, sheaths may contain either electrons or positive ions. Sheaths are regions of rapidly varying potential. Sheaths may form around any object that may exist in the plasma as well as at the surface of the material envelope containing the discharge. An insulated conductor in a plasma of a discharge has potential variation in the plasma. As long as the conductor is negative with respect with the plasma, positive ion current is collected by the conductor. A positive ion sheath forms around the conductor. The gas is ionized and a plasma is formed with a sheath at the walls of the insulator. When ions return to the frame they hit the sheath and cause electrons to be released which is an electron multiplication effect.

Figure 2:
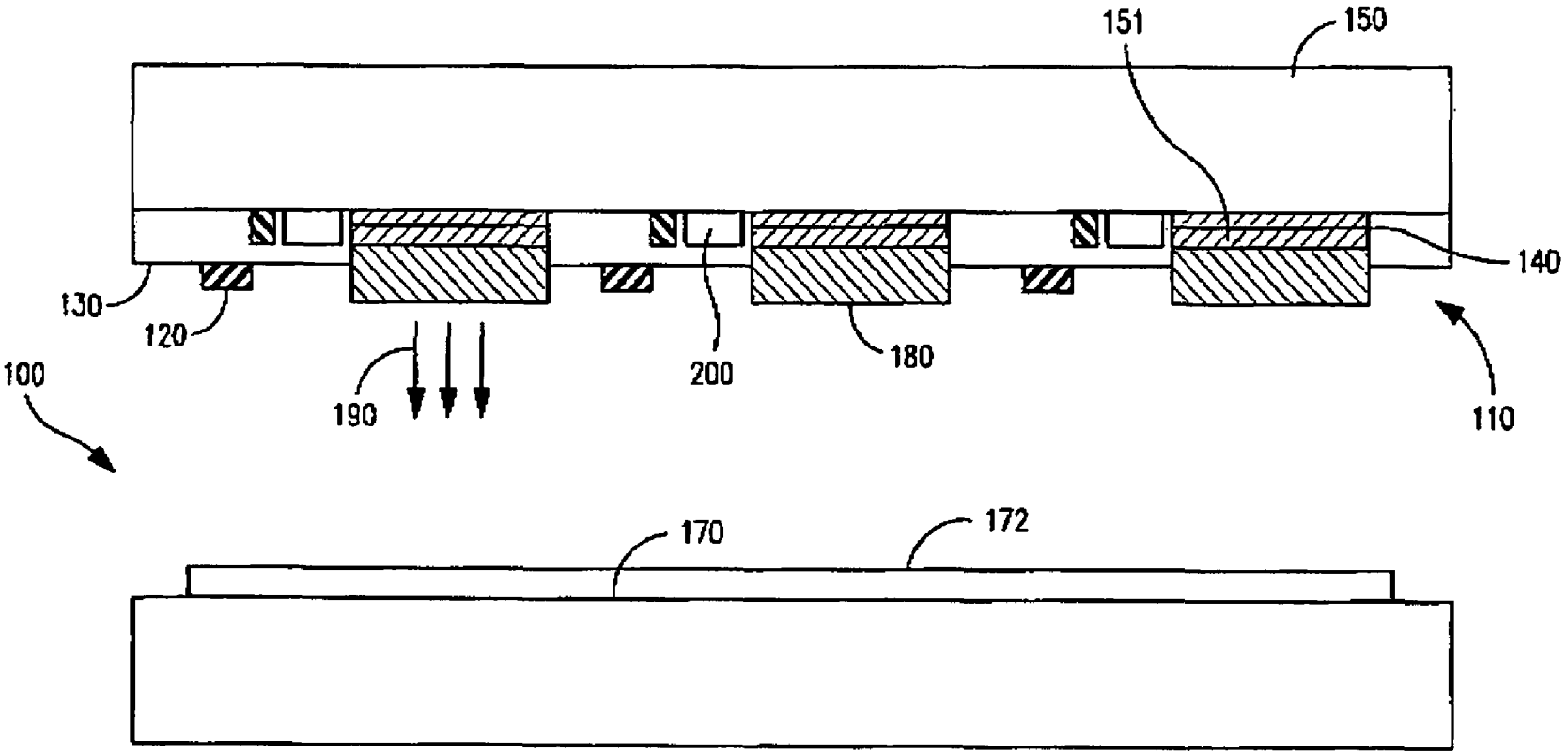
FIG. 2 illustrates an exemplary display device according to an aspect of the present invention.

Referring now to the figures, FIG. 2 illustrates a schematic cross-sectional view of a TFT anode based FPD 100 according to one aspect of the present invention. In the exemplary embodiment, display 100 is composed of an assembly 110 that includes an anode and that employs TFT circuitry to control the attraction of electrons, and a control frame structure 120 is disposed on an anode passivation layer 130. The control frame substantially surrounds and is adjacent to each of the pixel elements, and may support the cold cathode electron emitters. In the illustrated embodiment, the pixel metal 140 operates as the anode, which attracts electrons emitted by the cold cathode emitters located on the frame. Those of ordinary skill in the art may recognize that other configurations, with cold cathode emitter in various other locations are possible.

Assembly 110 of FIG. 2 includes a plurality of conductive pixel pads 140 fabricated in a matrix of substantially parallel rows and columns on a substrate 150 using conventional fabrication methods. Each pixel pad (FIG. 1) is covered with a thin layer of $SiO_2$ or $M_gO$ 151 as is the frame. The layer of insulator is covered with a layer of phosphor 180 for each pixel. Substrate 150 may be formed of a transparent material, such as glass, or a flexible material (such as a plastic with no internal outgassing during sealing and vacuumization processing), but may be opaque. Substrate 170, which serves to confine the FPD housing in an evacuated or an inert or noble gas environment may also be made of a transparent (or at least translucent) material, such as glass or flexible material, but alternatively may be opaque. In the exemplary embodiment depicted in FIG. 1, substrate 170 has a layer of metal (ML) 172 secured on or otherwise formed on the surface. The ML layer 172 as shown and configured relative to assembly 110. The ML layer 172 is transparent and may be ITO or some other metal. The substrates 150 and 170 are bonded or sealed at the peripheries to form an enclosed hollow which may be filled with an inert gas or a vacuum. Conductive pixel pads 140 may be composed of a transparent conductive material, such as ITO (Indium Titanium Oxide) or a non-transparent conductor such as Chrome (CR), Moly Chrome (MoCr) or aluminum.

In any event, deposited on each conductive pixel pad 140 is phosphor layer 180 over the insulator. Each phosphor layer(s) is selected from materials that emit light 190 of a specific color, wavelength, or range of wavelengths. In a conventional RGB display, phosphor layer 180 is selected from materials that produce red light, green light or blue light when struck by electrons. In the illustrated embodiment, light (i.e. photons) is emitted in the direction of substrate 170 for viewing. If the pixel metal is of a transparent (or translucent) material (such as ITO) rather than opaque, light emissions 190 would be transmitted in both the directions of substrates 150 and 170 (rather than being reflected via the pixel metal to substrate 170 only, for example).

Incorporated in the TFT circuit (FIG. 1) are conductive pixel column and row addressing lines associated with each of the corresponding conductive pixel pads 140. The pixel row and column addressing lines may be substantially perpendicular to one another. Such a matrix organization of conductive pixel pads and phosphor layers allows for X-Y addressing each of the individual pixel elements in the display as will be understood by those possessing an ordinary skill in the pertinent arts.

Associated with each conductive pixel pad 140/phosphor layer 180 pixel is a TFT circuit 300 (FIG. 1) that operates to apply an operating voltage proportional to the data to the associated conductive pixel pad 140/phosphor layer 180 pixel element. TFT circuit 300 operates to apply either a first voltage to bias an associated pixel clement to maintain it in an "off" state or a second voltage to bias the associated pixel element to maintain it in an "on" state as required by the data, or any intermediate state. In this illustrated case, conductive pixel pad 140 is inhibited from attracting electrons when in an "off" state, and attracts electrons when in an "on" or any intermediate state.

TFT circuitry 300 biasing conductive pixel pad 140 provides for dual functions of addressing pixel elements and maintaining the pixel elements in a condition to attract electrons for a desire time period, i.e., time-frame or sub-periods of time-frame.

Figure 3:
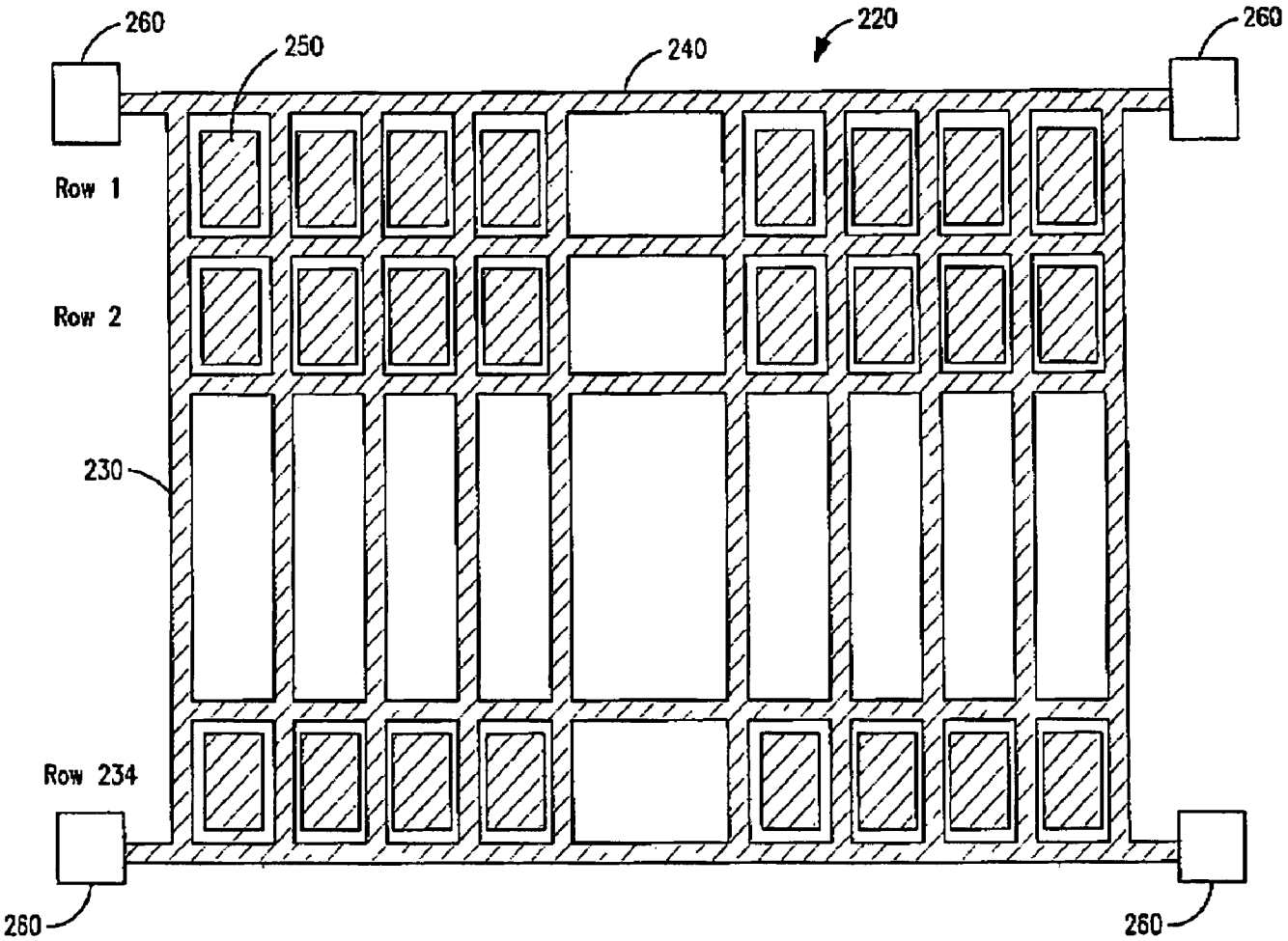
FIG. 3 illustrates a control frame around each pixel and having a DC, AC or pulsed voltage applied according to an aspect of the present invention.

Referring now also to FIG. 3, there is shown a plan view of a control frame 220 suitable for use as control frame 120 of FIG. 1. Control frame 220 includes a plurality of conductors arranged in a rectangular matrix having parallel vertical conductive lines 230 and parallel horizontal conductive lines 240, respectively. Each pixel 250 (e.g. pad 140 and phosphor 180 of FIG. 2) is bounded by vertical and horizontal conductors or lines 230, 240, such that the conductors substantially surround each pixel 250 to the right, left, top, and bottom. One or more conductive pads 260 or conductive bars electrically connect conductive frame 220 to a conventional power source. In the illustrated embodiment of FIG. 3, four conductive pads 260 are coupled to the conductive lines 230, 240 of frame 220. In an exemplary embodiment, each pad 260 is around 100×200 micrometers (microns) in size.

Figure 3A:
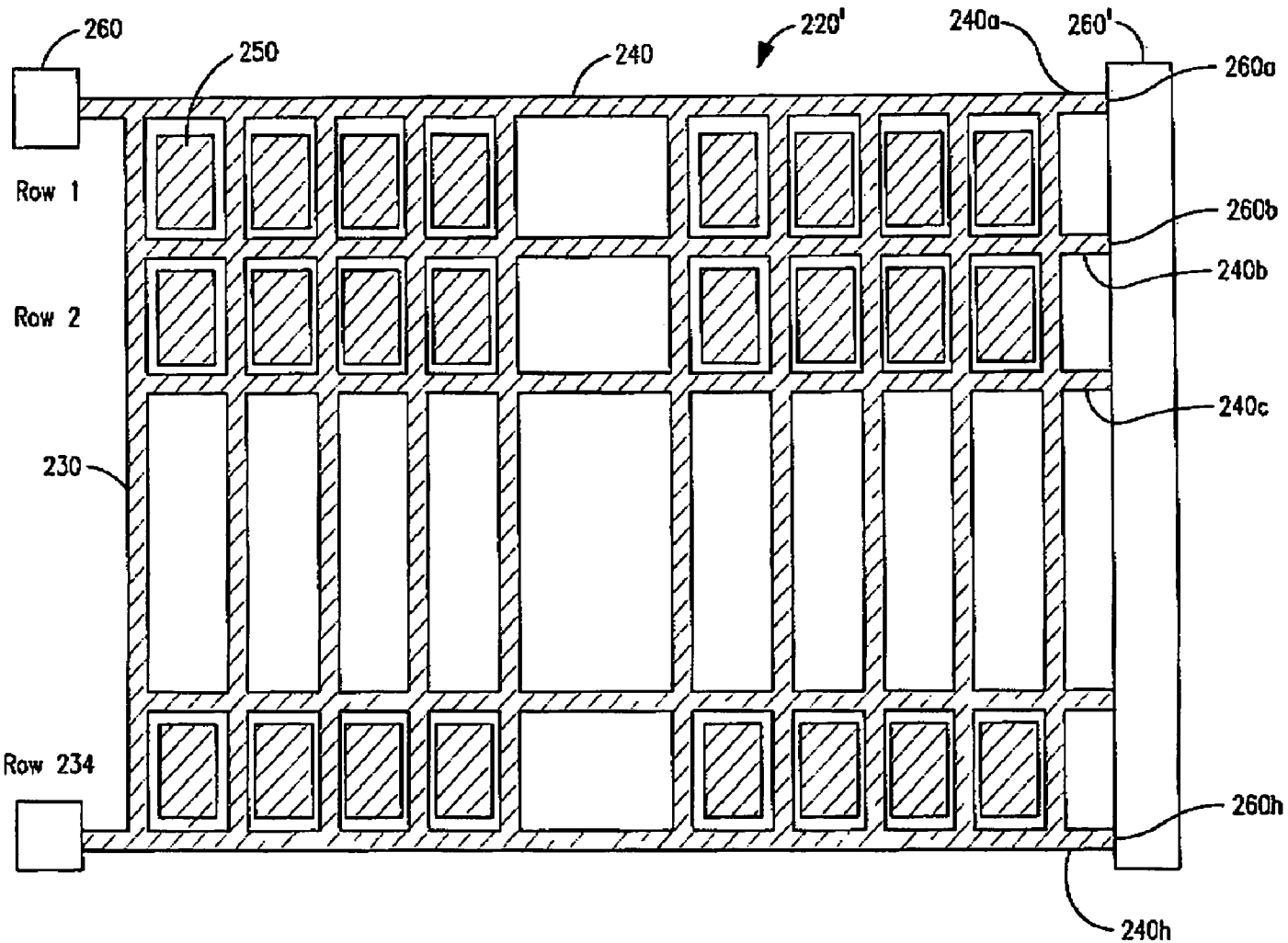
FIG. 3*a* illustrates a control frame according to another aspect of the present invention.

FIG. 3A shows another exemplary configuration of a control frame structure 220' similar to that of FIG. 3 (wherein like reference numerals are used to indicate like parts), but wherein two of the pads 260 of FIG. 2 are replaced by a single conductive bar or bus 260'. The conductive bar 260' is coupled to each of the parallel horizontal conductive lines 240*a*, 240*b*, 240*c*, . . . 240*n* at corresponding positions 260*a*, 260*b*, 260*c*, 260*n* along the bar. In the illustrated configuration, the row lines are substantially identical to one another and interconnect to the bar at uniform spacings along the length of the bar. This configuration provides for an equipotential frame configuration with minimal voltage drops as a function of frame position.

In the illustrated embodiment control frame 220 (or 220') is formed as a metal layer above the final passivation layer (e.g. 130, FIG. 1). Pads 260 and metal lines that provide the control frame structure 220 remain free from passivation in the illustrated embodiment. In an exemplary configuration, the control frame metal layer has a thickness of less than about 1 micron (μm), and a width may be used depending on particular design criteria.

According to one aspect of the present invention, nanostructures are provided upon control frame 220 which is coated with an insulator layer where the nanostructures are deposited on top of the insulator layer such as $SiO_2$ or $M_gO$ (FIG. 1) to provide cold cathode emission, other cold cathode emitters may also be incorporated. The nanostructures may take the form of carbon nanotubes, for example. The nanostructures may take the form of SWNTs or MWNTs. The nanostructures may be applied to the control frame using any conventional methodology, such as spraying, growth, or printing, for example.

While the vertical line conductors 230 and horizontal line conductors 240 frame each pixel 250 above the plane of the pixels 250 in the illustrated embodiment (see, e.g., FIG. 1), other configurations are contemplated, such as where the conductors are disposed in the same plane as the pixels. Further yet, conductors 230, 240 may be connected in a number of configurations. For example, in one configuration, all horizontal and vertical conductors are joined together as shown in FIG. 2 and a voltage is applied to the entire control frame configuration. In another configuration, all horizontal conductors 240 are joined and separately all vertical conductors 230 are joined. In this connection configuration the horizontal conductors 240 and vertical conductors 230 are not electrically interconnected. Thus, a voltage may be applied to the horizontal conductor array, and a separate voltage may be applied to the vertical conductor array. Other configurations are also contemplated, including for example, a configuration of all horizontal conductors only, or a configuration of all vertical conductors only. For example, the control frame may include only metal lines parallel to the columns or only metal lines parallel to the rows.

The anode (pixel) voltage ($V_{ANODE}$) of each pixel partly determines the brightness or color intensity of that pixel (FIG. 1). By positively biasing the pixel voltage ($V_{PIXEL}$) relative to the voltage of the frame, electrons, are then attracted to the positively biased pixel. The electrons which strike phosphor cause the phosphor to emit light. The wavelength of the emitted light depends upon the phosphor. The electron flow to the anode (i.e. pixel current) is a function of the pixel voltage, thereby producing an illumination which is proportional to the amplitude of column data, which is proportional to the amplitude of the image data. This is shown in co-pending applications as described in Related Applications.

According to an aspect of the present invention, control of one or more of the TFTs associated with the display device of the present invention may be accomplished using the circuit 300 of FIG. 1. Circuit 300 includes first and second transistors 310, 330 and capacitor 320 electrically interconnect with a pixel, e.g. pad 140, FIG. 1.

In general, the voltage used to select the row ($V_{ROW}$) is equal to the fully "on" voltage of the column (Vc). The row voltage in this case causes the pass transistor 310 to conduct. The resistance of pass transistor 310, capacitor 320 and the write time of each selected pixel row determines the voltage at the gate of transistor 330, as compared to Vc. $V_{ANODE}$ is the power supply voltage, and may be on the order of about 10-40 volts.

Figure 4:
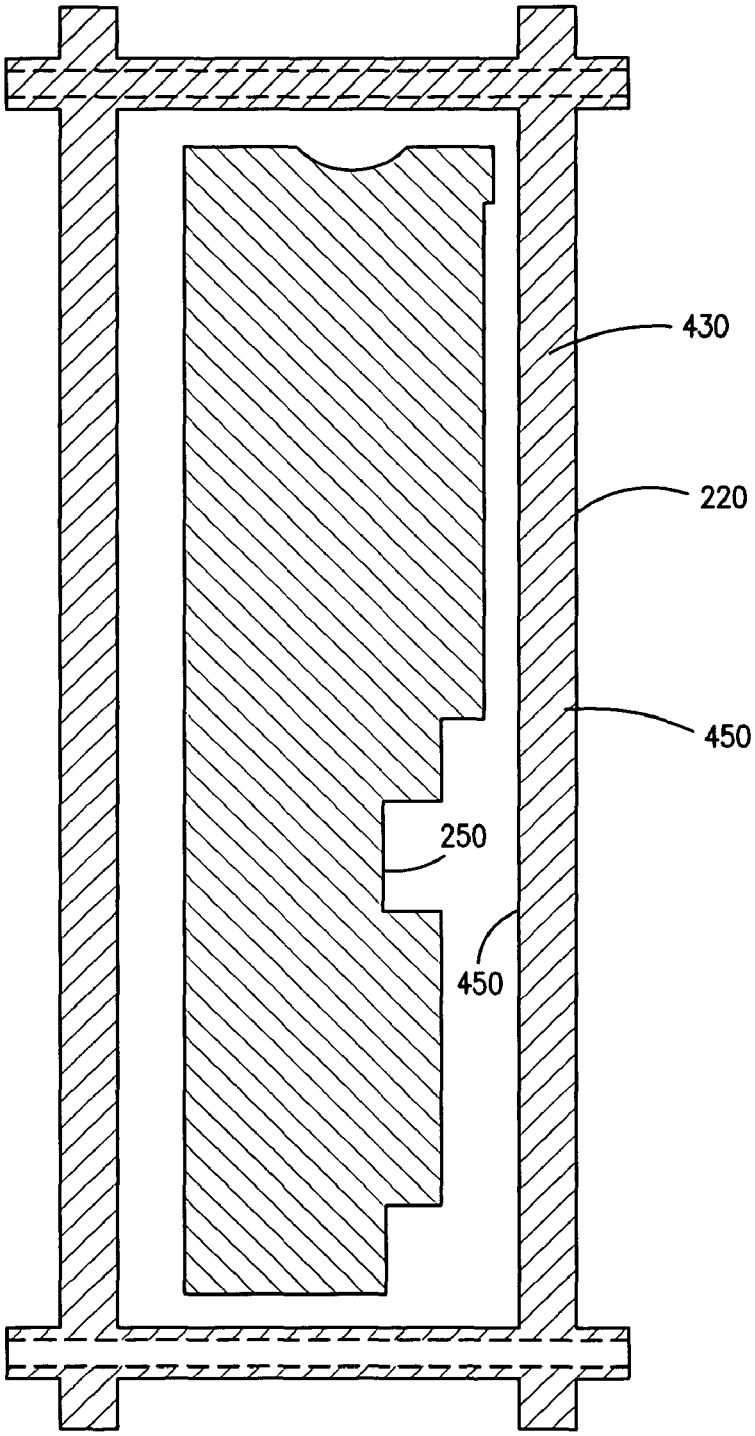
FIG. 4 illustrates a top view of a control frame according to another aspect of the present invention.

Referring to FIG. 4, the conductive part of frame 220 may be widened (e.g. by about 4 um) and an insulating layer 450 (e.g. SiN) provided at each edge for preventing electrical short circuits from the frame to the pixels, and to encapsulate the frame edge which is associated with high field intensity. Accordingly, the exposed part 430 of the frame may have a width w of about 12-15 um.

Emissive displays using phosphor to emit light in order to display an image including: a source of electrons, pixels including phosphor on a conductive surface, and a conductive layer (ML) capable of extracting electrons from the display surfaces. In a cold cathode display, as described herein, the source of electrons may be nanotubes, edge emitters, tips, and so on. The phosphor is placed on the pixels and light is emitted from the phosphor when the electrons emitted by the cold cathode strike the phosphor. The amplitude of the illumination is a linear function of the power consumed by the phosphor. The power is a linear function of the number of electrons arriving at the phosphor for a given voltage.

Therefore, any means to maximize the electron flow from the cold cathode to the phosphor will optimize the illumination and performance of the display.

By varying the voltage applied to ML and optimizing the effect of the field generated by the ML voltage, depending on the physical configuration of the display, will result in an increase of the electron flow from the cold cathode to the phosphor for a given pixel voltage, resulting in increased brightness and optimum display performance.

The DC, AC or pulsed voltage on ML for optimum performance is a function of the geometry of the components in the display and must be determined independently for the physical structure of the particular display.

The introduction of a noble gas, such as argon and/or mixtures of noble or ionizable gases at low pressure into the display, and applying a DC, AC or pulsed voltage to ML to create a plasma and coating the frame and pixel metal with an insulator creating a sheath results in multiplication of the current produced by the cold cathode electron emitting source, such as nanotubes, edge emitters, etc. by order of magnitude while the applied voltage is virtually constant. The coating with the insulator causes increased secondary emission as described while the creation of the sheath in the plasma cause electron multiplication and thus increases the brightness of the display without an increase in the cold cathode voltage applied. Since the photons (light level) emitted by the phosphor is a linear function of the power then the brightness, at a constant voltage on the pixel, is a linear function of the current. Since the current increases order of magnitude then the brightness will increase at the same rate. The creation of the plasma is a function of the DC, AC or pulsed voltage applied to the ML.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, the control frame described previously may be used with any display which uses electrons or charged particles to form an image. As discussed above, it is also understood that the present invention may be applied to flexible displays in order to form an image thereon.

It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display comprising:

a first substrate comprising;

a plurality of electrically addressable pixels, each of said pixels includes a conductive pad coated with an insulator and having a phosphor on said insulator;

a plurality of thin-film transistor (TFT) driver circuits each being electrically coupled to an associated one of said pixels;

a passivating layer on said thin-film transistor driver circuits and at least partially around said pixels;

a conductive frame on said passivating layer, said conductive frame at least partly coated with an insulating material, said insulating material being porous to allow current to pass therethrough;

a plurality of cold cathode emitters located in the vicinity of said pixels; and means for exciting said conductive frame and addressing one of said pixels using said associated TFT driver circuit to cause said cold cathode emitters to emit electrons which strike a phosphor causing said phosphor to emit light; and a second substrate including a metal layer thereon, wherein said first substrate and said second substrate are sealed about a periphery to form an internal hollow therein, said hollow being filled with at least one of: an inert gas and a mixture of inert gases; and means for applying a voltage to the metal layer to ionize the one of the inert gas and the mixture of inert gases to generate a plasma, wherein said electrons emitted by said cold cathode emitters further interact with ions in said plasma causing the ions to be attracted to said conductive frame area covered by said insulating material to cause additional electrons to be emitted from said conductive frame area, said additional electrons when striking said phosphor increase the light emitted by said phosphor.

2. The display of claim 1, wherein said cold cathode emitters are located on the conductive frame.

3. The display of claim 1, wherein said insulating material is selected from insulating materials capable of emitting electrons when impinged upon by ions.

4. The display of claim 1, wherein said insulating material is a thin layer of $SiO_2$ or MgO.

5. The display of claim 1, wherein a sheath boundary is formed between said plasma and said insulator.

6. The display of claim 1, wherein said conductive frame comprises a plurality of parallel columns of conductors.

7. The display of claim 1 , wherein said conductive frame comprise a matrix of row and column conductors defining a plurality of cells each associated with one of said pixels.

8. The display of claim 1 , wherein said cold cathode emitters comprise carbon nanotubes.

9. The display of claim 1, wherein said driver circuit comprises at least one transistor coupled to said pixel.

10. The display of claim 1, wherein said driver circuit comprises a first transistor coupled to said conductive pad and a second transistor and capacitor coupled to a gate of said first transistor.

11. The display of claim 10, wherein said first substrate is transparent.

12. A display comprising:

a first substrate;

a plurality of electrically addressable pixels supported on said first substrate, wherein each of said pixels comprises a conductive pad coated with an insulator and having a phosphor on said insulator;

a passivating layer surrounding each of said pixels;

a conductive frame supported by said passivating layer;

an insulating layer deposited on the conductive frame, said insulating layer being porous to allow current to pass therethrough;

a plurality of cold cathode emitters positioned on said conductive frame and operative to emit electrons when an associated pixel is addressed, said electrons when striking said phosphor cause said phosphor to emit light; and means for exciting said conductive frame and addressing one of said pixels to cause electrons to be emitted from the insulating layer on the conductive frame; and a transparent second substrate oppositely disposed from said first substrate, incorporating a conductive metal layer (ML) thereon, said first and second substrates sealed at their peripheries to form an internal hollow;

at least one of a noble gas and a mixture thereof filing the internal hollow; and means for applying a voltage to the conductive metal layer to ionize the at least one of a noble gas and a mixture thereof to generate a plasma, wherein said electrons emitted by said cold cathode emitters further interact with ions in said plasma causing the ions to be attracted to said conductive frame area covered by said insulating material to cause additional electrons to be emitted from said conductive frame area, said additional electrons when striking said phosphor increase the light emitted by said phosphor.

13. The display of claim 12, wherein said conductive frame comprise a matrix to row and column conductors defining a plurality of cells each associated with one of said pixels.

14. The display of claim 12, further comprising at least one contact pad electrically coupled to said conductive frame.

15. The display of claim 12, wherein said cold cathode emitters comprise carbon nanotubes.

16. The display of claim 12, further comprising a plurality of driver circuits each being electrically coupled to an associated at least one of said pixels, wherein each said driver circuit comprises at least one transistor coupled to said conductive pad.

17. The display of claim 12, wherein each said driver circuit comprises a first transistor coupled to said conductive pad, and a second transistor and a capacitor coupled to a gate of said first transistor.

18. The display of claim 12, wherein the ML layer having a DC, AC or pulsed voltage applied thereto controls the amplitude of cold cathode emission.

19. The display of claim 12, wherein said ML having a DC, AC or pulsed voltage to enhance a sheath boundary to form between said plasma and said insulating layer.

* * * * *